US006012398A

United States Patent [19]

Boyce

[11] Patent Number: 6,012,398

[45] Date of Patent: Jan. 11, 2000

[54] MODULAR TABLE

[75] Inventor: David L. Boyce, Damascus, Pa.

[73] Assignee: Boyce Products, Ltd., Damascus, Pa.

[21] Appl. No.: 09/216,717

[22] Filed: Dec. 18, 1998

[51] Int. Cl.[7] ..... A47B 85/00

[52] U.S. Cl. ..... 108/25; 108/64; D6/489

[58] Field of Search ..... 108/25, 50.02, 108/64, 150; D6/489, 480, 488

[56] References Cited

U.S. PATENT DOCUMENTS

| | | | |
|---|---|---|---|
| D. 291,853 | 9/1987 | Worrell et al. . | |
| D. 336,191 | 6/1993 | Deimen et al. . | |
| D. 370,807 | 6/1996 | Maple . | |
| D. 371,261 | 7/1996 | Harper et al. . | |
| 2,107,010 | 2/1938 | McDonald | 108/150 |
| 3,053,598 | 8/1962 | Cheslow . | |
| 3,342,147 | 9/1967 | Shettles | 108/64 |
| 3,533,362 | 10/1970 | Thompson . | |
| 3,741,852 | 6/1973 | Keener . | |
| 4,732,088 | 3/1988 | Koechlin et al. . | |
| 4,922,835 | 5/1990 | Van Vliet et al. . | |
| 5,438,937 | 8/1995 | Ball et al. . | |
| 5,595,126 | 1/1997 | Yeh . | |

FOREIGN PATENT DOCUMENTS

| | | | |
|---|---|---|---|
| 1276836 | 6/1972 | United Kingdom | 108/64 |

*Primary Examiner*—Peter M. Cuomo
*Assistant Examiner*—Gerald A. Anderson
*Attorney, Agent, or Firm*—Rhodes & Mason, PLLC

[57] ABSTRACT

A modular table, such as a conference table is constructed of a plurality of detachable, connected modules. Each module has a top in the shape of an equilateral triangle that is formed by connecting three identical triangular sections, each triangular section has a base side forming an outer edge of the module top, a second side and a third side. The second and third sides are joined at an angle of 120°. Preferably, the second and third said of each triangular section are of different lengths, so that a central opening is formed in the top of each module. A base supporting each module preferably has an opening so that utilities can be connected from a floor beneath the table to the table top through openings in the modules and base.

12 Claims, 3 Drawing Sheets

MODULAR TABLE

BACKGROUND OF THE INVENTION (1) Field of the Invention

The present invention relates generally to a modular table, such as a conference table, and in particular to a modular table formed of a plurality of modules having triangular-shaped tops, each top having a central opening and being formed of three identical triangular-shaped components.

(2) Description of the Prior Art

It is known in the prior art to form a table of a size that will accommodate the presence of several persons, such as a conference table, by attaching several sections or modules so that their tops are fitted together in a common plane to form the top of a single table. Generally, each module is comprised of a horizontal, planar top, and a support basic, which may be of various forms, such as a pedestal or a plurality of legs.

The modules that are joined to form the table may be of a plurality of shapes, such as those illustrated in the following patents:

| | |
|---|---|
| 5,595,126 | Yeh |
| 3,741,852 | Keener |
| 3,053,598 | Cheslow |
| 4,922,835 | Van Vliet et al. |
| 5,438,937 | Ball et al. |
| 4,732,088 | Koechlin et al. |

Alternatively, the table can be formed of a plurality of identical modules, such as those described in U.S. Pat. No. 3,342,147 to Shettles al., relating to a table constructed from a plurality of triangular-shaped individual table modules with solid one-piece tops.

Prior art modular tables, however, do not make any provision for utilization with modern computing equipment or other electrical or electronic equipment that must be attached to electrical outlets or other utility outlets that are frequently positioned in the floor beneath the table. In addition, the tops of the modules are costly to manufacture, or have such a small surface area that several modules must be joined to form a work surface suitable for several people. In other constructions, the table requires the joinder of several different shaped modules, resulting in a more expensive product to manufacture, and reducing the number of possible table configurations.

Thus, there is a continuing need for a modular table, such as a conference table, that can be constructed by joining identical table modules in various configurations, with the top of each module, in turn, being constructed of identical components to reduce the manufacturing cost. In addition, there is a need for a modular table that is formed of modules permitting access through the top of the modular table to electrical and other utility outlets positioned beneath the table.

SUMMARY OF THE INVENTION

The present invention is directed to a table, such as a conference table, comprised of a plurality of modules that can be arranged in a variety of designs to produce tables of different shapes. Each module has a top with an exterior periphery in the shape of an equilateral triangle, i.e., the top has three sides of equal length. The center of the modular top includes an opening providing access to the floor beneath the table.

For ease of construction, and for economical reasons, each top is formed of three identical triangular components, each having a base, and first and second sides, with one of the sides being longer than the other. The triangular components are attached to each other in a plane, with the bases of the triangular components forming the periphery of the module. That is, when assembled, the base of each triangular component forms one side of the module.

In order for the three triangular components to form a table top in the shape of an equilateral triangle, the angle at the juncture of the first and second sides, i.e., the apex of the triangle, will be 120°. Therefore, the sum of the angles between the base and the first side, and the base and the second side will equal 60°. Preferably the angle between the base and the first side is from about 31° to about 45°, and even more preferably, for about 35° to about 40°.

When assembled, the first side of each triangular component is aligned with the second side of another triangular segment. All of the triangular components are turned in either a clockwise or counter-clockwise direction when viewed from the top. As a result, of this orientation, the fact that one side of each segment is shorter than its other side, and the fact that all triangular components have the same dimensions, a triangular-shaped opening is left in the center of the assembled module so that utilities can be extended from beneath the table to the table surface.

Each module also includes a base assembly, also constructed of three identical components, with central vertical openings positioned beneath the tabletop opening. Therefore, when the base assembly is placed over a utility outlet, the utilities can be extended from the floor through the base assembly central opening and then through the tabletop opening above the base. For example, the base assembly may be comprised of three leg segments that are joined together around a central triangular opening. This central base opening can then be placed directly beneath the opening in the table top to form a continuous pathway from the floor to the table top for wiring and other utilities.

Accordingly, it is an object of the invention to provide a table module comprising a top in the shape of an equilateral triangle having an upper surface and a lower surface, the top being formed of three identical triangular sections, each of the sections having a base side forming an outer edge of the top, a second side and a third side, the second and third sides being joined at an angle of 120°; and a base supporting the top.

Another aspect is to provide a module of the above configuration in which the top includes a central opening resulting from the third side of each of the sections being longer than the third side, and the base includes an opening beneath the top central opening, whereby utilities can be connected from beneath the top through the base opening and the top opening.

It is another aspect to the invention to provide a modular table constructed of a plurality of connected modules of the above configuration.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. Like elements are designated by like numbers. The drawings are for the purpose of illustrating the invention and are not intended to be to scale.

The present invention is directed to a table, comprised of a plurality of modules, generally 10, and to the construction of such modules. Each module has a top formed of three identical top sections 12, and a base, generally 14, centrally mounted beneath each of modules 10.

Figure 1:
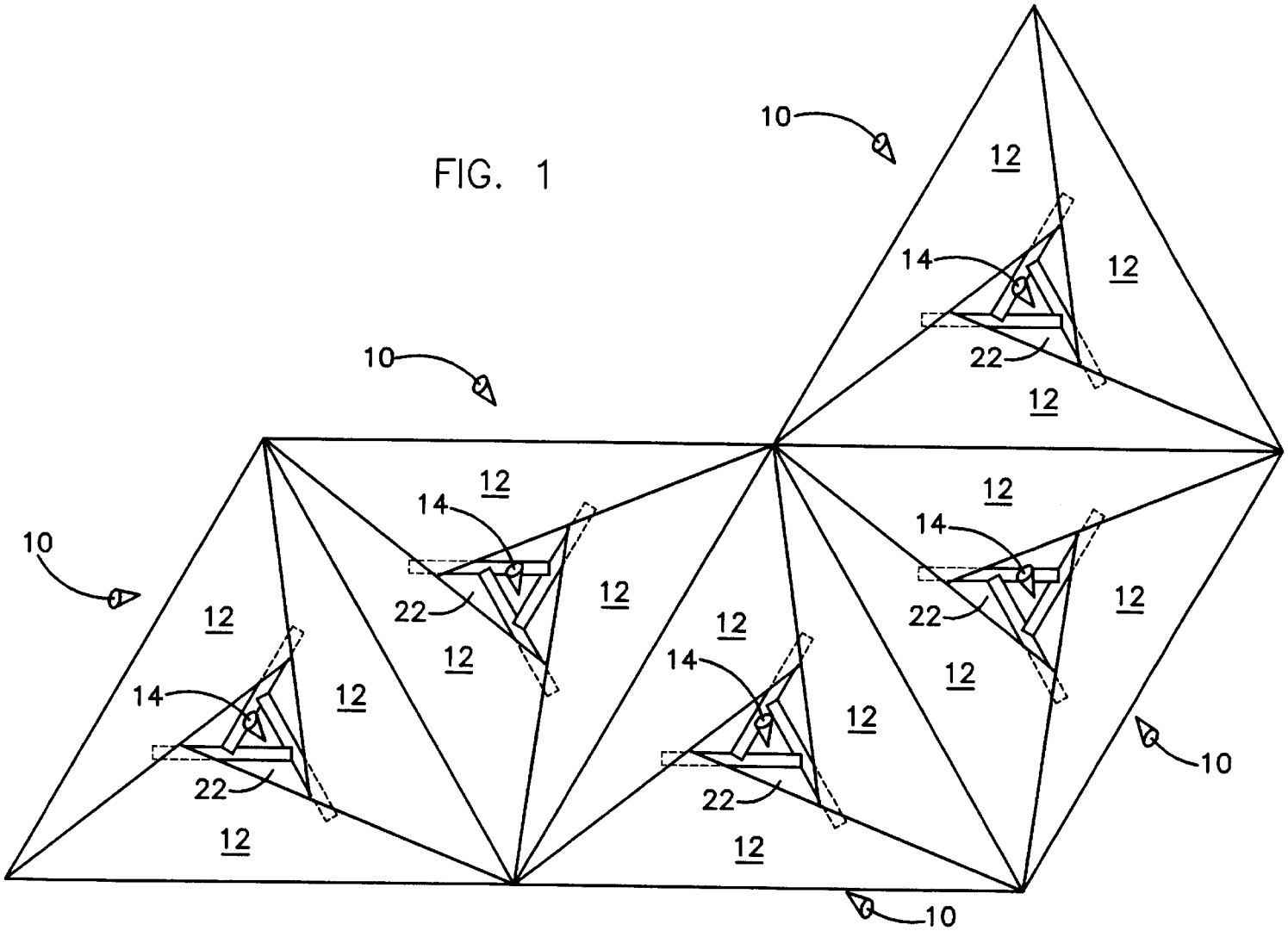
FIG. 1 is a top view of a modular table in accordance with the present invention.
Figure 2:
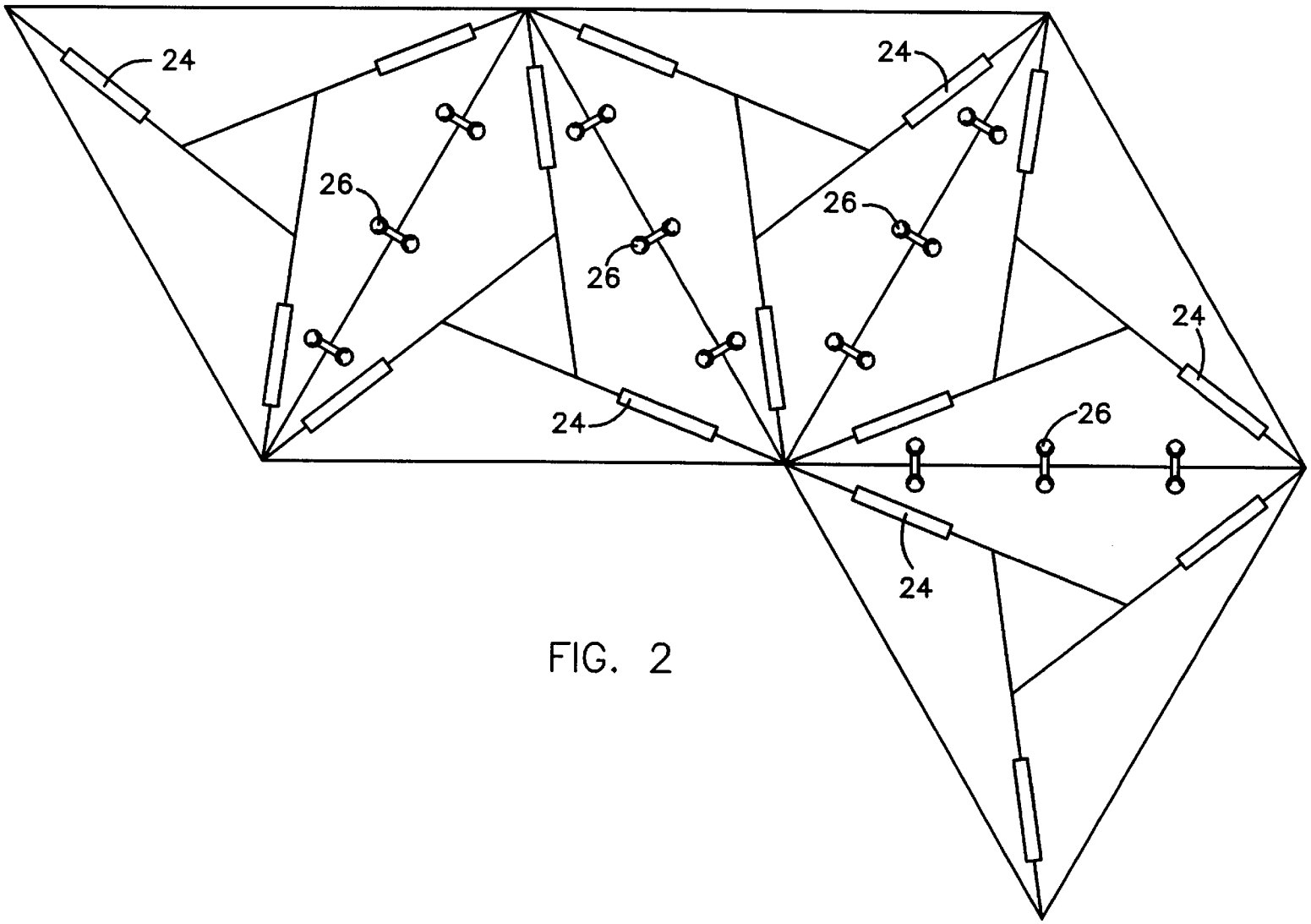
FIG. 2 is view of the underside of the table of FIG. 1.
Figure 4:
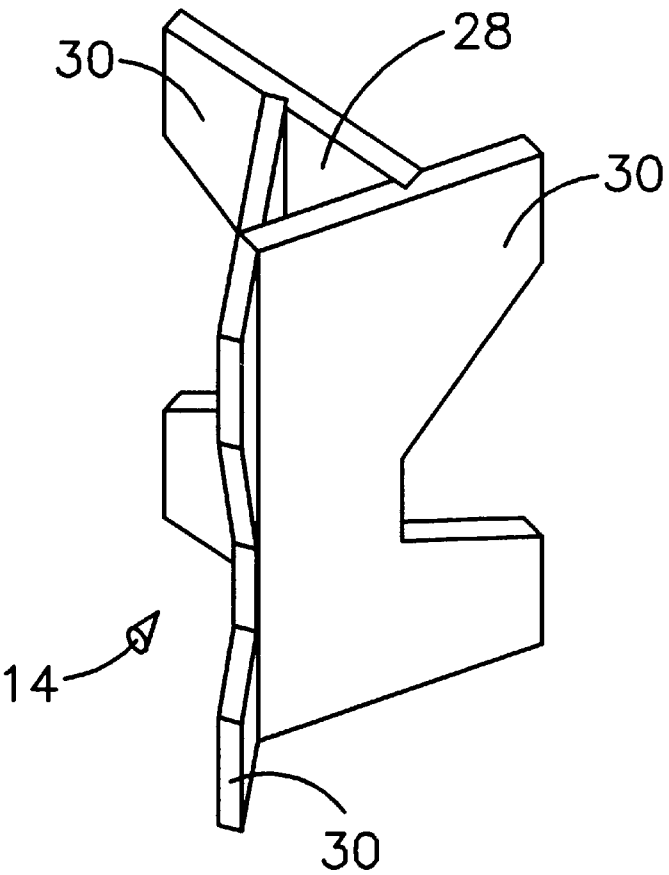
FIG. 4 is a perspective view of the base of a table module.
Figure 3:
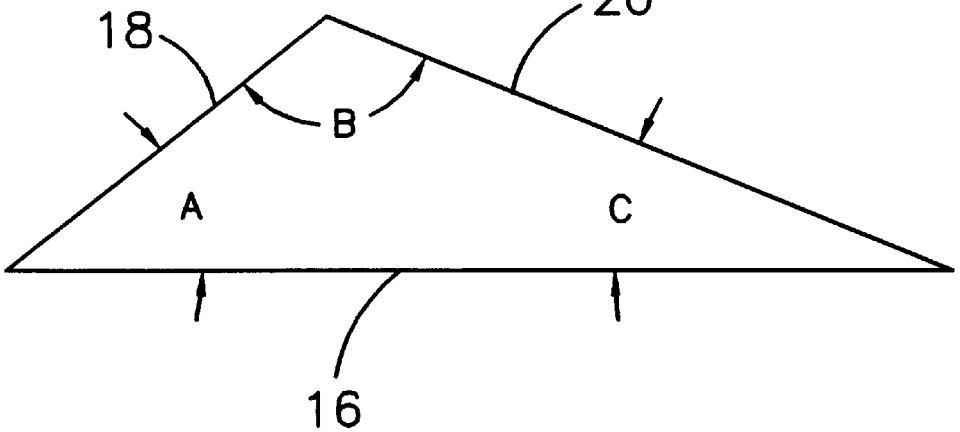
FIG. 3 is a top view of one of the triangular components used to form the module top, illustrating the various angles required.

One possible table configuration is shown in FIGS. 1 and 2. In this embodiment, five modules 10 are attached to form the table. Each module 10 has a top in the shape of an equilateral triangle, and is constructed of three top sections 12 that lie in a common plane. As best illustrated in FIG. 3, each top section 12 has a first or base side 16, a second side 18, and a third side 20. The base side 12 of each section 12 is oriented to the outside of the module top to form an edge. Each second side 18 abuts, and is attached to, the third side 20 of an adjacent section 12.

The respective angles at the corners of the sides are critical to the construction of the module top. Referring to FIG. 3, angle (B) at the joinder of sides 18 and 20 must be 120° in order for the three triangles to form a table top in the shape of an equilateral triangle. Since the sum of the three angles must equal 180°, and since no opening will be left in the center of the module top if angles (A) and (C) are the same, angle (A) must be greater than angle (C) in order for there to be an opening in the center of the module.

In other words, angle (A) is greater than 30°, while angle (C) is equal to 60° minus the angle of angle (A). Therefore, the sum of the angles between the base and the first side, and the base and the second side will equal 60°. In the illustrated module, angle (B) is 120°, angle (A) is approximately 38°, and angle (C) is approximately 22°.

Since angles (A) and (C) are different, an opening 22 remains in the center of module 10 after the three sections 12 have been assembled, permitting wiring, cables and other connectors, referred to herein collectively as utilities, to be brought up through the center of the module, instead of around the edges, where the wiring could interfere with the seating of personnel. In view of the above configuration of the sections 12, opening 22 is also in the shape of an equilateral triangle.

As best seen in FIG. 2, sections 12 are joined at their abutting edges with strip fasteners 24 that are screwed into the under surfaces of sections 12, forming a more or less permanent structure. The tops of modules 10 are then releasibly attached to each other with releasable fasteners 26, which are preferably of a different construction from fasteners 24 to permit ease of assembly and reassembly of the modules to construct tables of different sizes and configurations.

Each module top is supported on a base, generally 14, that includes an opening 28 aligned beneath opening 22 in the supported top. As a result, base 14 can be positioned over a floor outlet (not shown) and utilities can be strung from the outlet through openings 28 and 22 to the top of the table.

The exact configuration of base 14 is not critical to the invention, so long as an opening beneath module opening 22 is a part of the base structure. In the illustrated preferred embodiment, base 14 is constructed of three identical rectangular legs 30. Each leg 30 includes a side edge attached equidistant along the inner side wall of the other leg 30. As a result, opening 28 is in the shape of a triangular conduit extending from the floor to the under surface of the table top, thereby hiding and protecting any utilities that are strung through opening 28.

Certain modifications and improvements will occur to those skilled in the art upon a reading of the foregoing description. Such modifications and improvements have been deleted herein for the sake of conciseness and readability but are properly within the scope of the follow claims.

What is claimed is:

1. A table comprised of a plurality of connected modules, each of said modules having a top in the shape of an equilateral triangle with an upper surface a lower surface, said top being formed of three identical triangular sections, each of said sections having a base side forming an outer edge of said top, a second side, and a third side, the second side of each section abutting the third side of another section, said second and third sides being of different lengths, whereby a central opening is formed in said top, and a base beneath said module top.

2. The table of claim 1, wherein each base includes an opening beneath said module top central opening, whereby utilities can be connected from beneath said top through said base opening and said top opening.

3. The module of claim 2, wherein said base opening is in the shape of an equilateral triangle.

4. The table of claim 1, wherein each base is formed of legs joined to form a central conduit extending from the bottom of said base to the top of said base.

5. The module of claim 1, wherein the base side and the second side of each triangular section join at an angle of from 31° to about 45°.

6. The module of claim 1, wherein each base is formed of three rectangular legs, each leg having an inner wall and a side edge, the side edge of each leg abutting the inner wall of an adjacent leg.

7. A table module comprising:

a) a top in the shape of an equilateral triangle having an upper surface and a lower surface, said top being formed of three identical triangular sections, each of said sections having a base side forming an outer edge of said top, a second side, and a third side, the second side of each section abutting the third side of another section, said second and third sides being of different lengths, whereby a central opening is formed in said top; and b) a base supporting said top.

8. The module of claim 7, wherein said base is formed of three rectangular legs, each leg having an inner wall and a side edge, the side edge of each leg abutting the inner wall of an adjacent leg.

9. The module of claim 7, wherein said base side and said second side join at an angle of from 31° to about 45°.

10. The module of claim 7, wherein said base is formed of legs joined to form a central conduit extending from the bottom of said base to the top of said base.

11. The table module of claim 7, wherein said base includes an opening beneath said top central opening, whereby utilities can be connected from beneath said top through said base opening and said central opening.

12. The module of claim 11, wherein said base opening is in the shape of an equilateral triangle.

* * * * *